US007794906B2

(12) United States Patent
Wu

(10) Patent No.: US 7,794,906 B2
(45) Date of Patent: Sep. 14, 2010

(54) CARBAZOLE HOLE BLOCKING LAYER PHOTOCONDUCTORS

(75) Inventor: Jin Wu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 418 days.

(21) Appl. No.: 12/059,536

(22) Filed: Mar. 31, 2008

(65) Prior Publication Data

US 2009/0246668 A1 Oct. 1, 2009

(51) Int. Cl.
*G03G 5/14* (2006.01)

(52) U.S. Cl. ..... 430/65; 430/63

(58) Field of Classification Search ..... 430/63, 430/65

See application file for complete search history.

(56) References Cited

U.S. PATENT DOCUMENTS

| | | | | |
|---|---|---|---|---|
| 4,265,990 | A | 5/1981 | Stolka et al. | |
| 4,298,697 | A | 11/1981 | Baczek et al. | |
| 4,338,390 | A | 7/1982 | Lu | |
| 4,464,450 | A | 8/1984 | Teuscher | |
| 4,560,635 | A | 12/1985 | Hoffend et al. | |
| 4,587,189 | A | 5/1986 | Hor et al. | |
| 4,921,773 | A | 5/1990 | Melnyk et al. | |
| 5,473,064 | A | 12/1995 | Mayo et al. | |
| 5,482,811 | A | 1/1996 | Keoshkerian et al. | |
| 5,521,306 | A | 5/1996 | Burt et al. | |
| 5,641,599 | A | 6/1997 | Markovics et al. | |
| 6,864,027 | B2 * | 3/2005 | Suzuki | 430/60 |
| 6,913,863 | B2 | 7/2005 | Wu et al. | |
| 7,507,511 | B2 * | 3/2009 | Tamoto et al. | 430/60 |
| 2006/0204872 | A1 | 9/2006 | Tong et al. | |
| 2007/0049677 | A1 | 3/2007 | Wu et al. | |
| 2007/0243476 | A1 | 10/2007 | Lin et al. | |
| 2008/0008947 | A1 | 1/2008 | Wu | |
| 2008/0032219 | A1 | 2/2008 | Lin et al. | |

FOREIGN PATENT DOCUMENTS

| | | |
|---|---|---|
| EP | 0 784 236 | 7/1997 |
| EP | 1 640 808 | 3/2006 |

* cited by examiner

*Primary Examiner*—John L Goodrow
(74) *Attorney, Agent, or Firm*—E. O. Palazzo

(57) ABSTRACT

A photoconductor that includes, for example, a substrate; an undercoat layer thereover wherein the undercoat layer contains a metal oxide and a carbazole containing compound; a photogenerating layer; and at least one charge transport layer.

31 Claims, No Drawings

CARBAZOLE HOLE BLOCKING LAYER PHOTOCONDUCTORS

CROSS REFERENCE TO RELATED APPLICATIONS

U.S. application Ser. No. 2009/0246658, filed concurrently herewith by Liang-Bih Lin et al. on Thiuram Tetrasulfide Containing Photogenerating Layer, the disclosure of which is totally incorporated herein by reference.

U.S. application Ser. No. 2009/0246659, filed concurrently herewith by Liang-Bih Lin et al. on Benzothiazole Containing Photogenerating Layer, the disclosure of which is totally incorporated herein by reference.

U.S. application Ser. No. 2009/0246662, filed concurrently herewith by Jin Wu et al. on Hydroxyquinoline Containing Photoconductors, the disclosure of which is totally incorporated herein by reference.

U.S. application Ser. No. 2009/0246660, filed concurrently herewith by Jin Wu on Additive Containing Photoconductors, the disclosure of which is totally incorporated herein by reference.

U.S. application Ser. No. 2009/0246664, filed concurrently herewith by Jin Wu on Oxadiazole Containing Photoconductors, the disclosure of which is totally incorporated herein by reference.

U.S. application Ser. No. 2009/0246667, filed concurrently herewith by Jin Wu on Titanocene Containing Photoconductors, the disclosure of which is totally incorporated herein by reference.

U.S. Application Ser. No. 2009/0246666, filed concurrently herewith by Jin Wu et al. on Thiadiazole Containing Photoconductors, the disclosure of which is totally incorporated herein by reference.

U.S. application Ser. No. 2009/0246657, filed concurrently herewith by Jin Wu et al. on Overcoat Containing Titanocene Photoconductors, the disclosure of which is totally incorporated herein by reference.

U.S. application Ser. No. 2009/0246661, filed concurrently herewith by Daniel Levy et al. on Urea Resin Containing Photogenerating Layer Photoconductors, the disclosure of which is totally incorporated herein by reference.

U.S. application Ser. No. 2009/0246665, filed concurrently herewith by Jin Wu et al. on Metal Oxide Overcoated Photoconductors, the disclosure of which is totally incorporated herein by reference.

Illustrated in copending U.S. application Ser. No. 11/831, 440, filed Jul. 31, 2007, entitled Iron Containing Hole Blocking Layer Containing Photoconductors, the disclosure of which is totally incorporated herein by reference, is a photoconductor comprising a substrate; an undercoat layer thereover wherein the undercoat layer comprises a metal oxide, and an iron containing compound; a photogenerating layer; and at least one charge transport layer.

Illustrated in copending U.S. application Ser. No. 11/831, 453, filed Jul. 31, 2007, entitled UV Absorbing Hole Blocking Layer Containing Photoconductors, the disclosure of which is totally incorporated herein by reference, is a photoconductor comprising a substrate; an undercoat layer thereover wherein the undercoat layer comprises a metal oxide, and an ultraviolet light absorber component; a photogenerating layer; and at least one charge transport layer.

Illustrated in copending U.S. application Ser. No. 11/831, 476, entitled Iodonium Hole Blocking Layer Photoconductors, the disclosure of which is totally incorporated herein by reference, is a photoconductor comprising a substrate; an undercoat layer thereover wherein the undercoat layer comprises a metal oxide and an iodonium containing compound; a photogenerating layer; and at least one charge transport layer.

Illustrated in copending U.S. application Ser. No. 11/831, 469, filed Jul. 31, 2007, entitled Copper Containing Hole Blocking Layer Photoconductors, the disclosure of which is totally incorporated herein by reference, is a photoconductor comprising a substrate; an undercoat layer thereover wherein the undercoat layer comprises a metal oxide, and a copper containing compound; a photogenerating layer; and at least one charge transport layer.

Illustrated in copending U.S. application Ser. No. 11/211, 757, U.S. Publication No. 20070049677, filed Aug. 26, 2005, entitled Thick Electrophotographic Imaging Member Undercoat Layers, the disclosure of which is totally incorporated herein by reference, are binders containing metal oxide nanoparticles, and a co-resin of phenolic resin and aminoplast resin, and an electrophotographic imaging member undercoat layer containing the binders.

Disclosed in copending U.S. application Ser. No. 11/764, 489 filed Jun. 18, 2007, entitled Hole Blocking Layer Containing Photoconductors, the disclosure of which is totally incorporated herein by reference, is a photoconductor comprising a substrate; an undercoat layer thereover wherein the undercoat layer comprises a metal oxide, an electron donor, and an electron acceptor charge transfer complex; a photogenerating layer; and at least one charge transport layer.

Disclosed in copending U.S. application Ser. No. 11/403, 981, U.S. Publication No. 20070243476, filed Apr. 13, 2006, entitled Imaging Members, the disclosure of which is totally incorporated herein by reference, is an electrophotographic imaging member, comprising a substrate, an undercoat layer disposed on the substrate, wherein the undercoat layer comprises a polyol resin, an aminoplast resin, and a metal oxide dispersed therein; and at least one imaging layer formed on the undercoat layer, and wherein the polyol resin is, for example, selected from the group consisting of acrylic polyols, polyglycols, polyglycerols, and mixtures thereof.

Illustrated in copending U.S. patent application Ser. No. 11/481,642, U.S. Publication No. 20080008947 filed Jul. 6, 2006, the disclosure of which is totally incorporated by reference herein, is an imaging member including a substrate; a charge generation layer positioned on the substrate; at least one charge transport layer positioned on the charge generation layer; and an undercoat or hole blocking layer positioned on the substrate on a side opposite the charge generation layer, the undercoat layer comprising a binder component and a metallic component comprising a metal thiocyanate and metal oxide.

Disclosed in copending U.S. application Ser. No. 11/496, 790, U.S. Publication No. 20080032219 filed Aug. 1, 2006, the disclosure of which is totally incorporated herein by reference, is a photoconductor member comprising a substrate; an undercoat layer thereover wherein the undercoat layer comprises a polyol resin, an aminoplast resin, a polyester adhesion component and a metal oxide; and at least one imaging layer formed on the undercoat layer.

Disclosed in copending U.S. application Ser. No. 11/714, 600 filed Mar. 6, 2007, the disclosure of which is totally incorporated herein by reference, is a photoconductor comprising a substrate; an undercoat layer thereover wherein the undercoat layer comprises an electroconducting component dispersed in a rapid curing polymer matrix; a photogenerating layer, and at least one charge transport layer.

The appropriate components and processes, number and sequence of the layers, component and component amounts in each layer, and the thicknesses of each layer of the above copending applications, may be selected for the present disclosure photoconductors in embodiments thereof.

BACKGROUND

There are disclosed herein hole blocking layers, and more specifically, photoconductors containing a hole blocking layer or undercoat layer (UCL) comprised, for example, of a metal oxide, a polymer binder, and an carbazole compound, such as a hydroxycarbazole like 4-hydroxycarbazole, and wherein in embodiments the carbazole is chemically attached to the polymer binder, which attachment in embodiments results from the presence of hydroxyl functional groups on the carbazole, for example, where the carbazole is attached to a phenol resin binder via the hydroxyl functional groups or other suitable groups present in the carbazole. More specifically, there are disclosed herein carbazole containing undercoat or hole blocking layers, which layers or layer further include some of the components as illustrated in the copending applications referred to herein, such as a metal oxide like a titanium dioxide.

In embodiments, photoconductors comprised of the disclosed hole blocking or undercoat layer enables, for example, excellent cyclic stability, and thus color print stability especially for xerographic generated color copies. Excellent cyclic stability of the photoconductor refers, for example, to almost no or minimal change in a generated known photoinduced discharge curve (PIDC), especially no or minimal residual potential cycle up after a number of charge/discharge cycles of the photoconductor, for example 200 kilo cycles, or xerographic prints, for example from about 80 to about 200 kilo prints. Excellent color print stability refers, for example, to substantially no or minimal change in solid area density, especially in 60 percent halftone prints, and no or minimal random color variability from print to print after a number of xerographic prints, for example 50 kilo prints.

Further, in embodiments the photoconductors disclosed may, it is believed, possess the minimization or substantial elimination of undesirable ghosting on developed images, such as xerographic images, including improved ghosting at various relative humidity; excellent cyclic and stable electrical properties; minimal charge deficient spots (CDS); and compatibility with the photogenerating and charge transport resin binders, such as polycarbonates. Charge blocking layer and hole blocking layer are generally used interchangeably with the phrase "undercoat layer".

The need for excellent print quality in xerographic systems is of value, especially with the advent of color. Common print quality issues can be dependent on the components of the undercoat layer (UCL). In certain situations, a thicker undercoat is desirable, but the thickness of the material used for the undercoat layer may be limited by, in some instances, the inefficient transport of the photoinjected electrons from the generator layer to the substrate. When the undercoat layer is too thin, then incomplete coverage of the substrate may sometimes result due to wetting problems on localized unclean substrate surface areas. The incomplete coverage may produce pin holes which can, in turn, produce print defects such as charge deficient spots (CDS) and bias charge roll (BCR) leakage breakdown. Other problems include "ghosting" resulting from, it is believed, the accumulation of charge somewhere in the photoreceptor. Removing trapped electrons and holes residing in the imaging members is a factor to preventing ghosting. During the exposure and development stages of xerographic cycles, the trapped electrons are mainly at or near the interface between the charge generation layer (CGL) and the undercoat layer (UCL), and holes are present mainly at or near the interface between the charge generation layer and the charge transport layer (CTL). The trapped charges can migrate according to the electric field during the transfer stage where the electrons can move from the interface of CGL/UCL to the CTL/CGL, and become deep traps that are no longer mobile. Consequently, when a sequential image is printed, the accumulated charge results in image density changes in the current printed image that reveals the previously printed image. Thus, there is a need to minimize or eliminate charge accumulation in photoreceptors without sacrificing the desired thickness of the undercoat layer, and a need for permitting the UCL to properly adhere to the other photoconductive layers, such as the photogenerating layer, for extended time periods, such as for example, about 2,000,000 simulated xerographic imaging cycles, and other advantages as compared to a number of known photoconductors that generate adverse print quality characteristics. For example, ghosting, charge deficient spots, and bias charge roll leakage breakdown are problems that may occur with a number of known photoconductors. With regard to ghosting, which is believed to result from the accumulation of charge somewhere in the photoconductor, consequently, when a sequential image is printed, the accumulated charge results in image density changes in the current printed image that reveals the previously printed image.

Thick undercoat layers are sometimes desirable for xerographic photoconductors as such layers permit photoconductor life extension and carbon fiber resistance. Furthermore, thicker undercoat layers permit the use of economical substrates in the photoreceptors. Examples of thick undercoat layers are disclosed in U.S. Pat. No. 7,312,007, the entire disclosure of which is totally incorporated herein by reference. However, due primarily to insufficient electron conductivity in dry and cold environments, the residual potential in conditions, such as 10 percent relative humidity and 70° F., can be high when the undercoat layer is thicker than about 15 microns, and moreover, the adhesion of the UCL may be poor, disadvantages avoided or minimized with the UCL of the present disclosure.

Also included within the scope of the present disclosure are methods of imaging and printing with the photoconductive devices illustrated herein. These methods generally involve the formation of an electrostatic latent image on the imaging member, followed by developing the image with a toner composition comprised, for example, of a thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, the imaging members, photoconductor drums, and flexible belts disclosed herein can be selected for the Xerox Corporation iGEN3® machines that generate with some versions over 100 copies per minute. Processes of imaging, especially xerographic imaging and printing, including digital, and/or high speed color printing, are thus encompassed by the present disclosure.

The photoconductors disclosed herein are in embodiments sensitive in the wavelength region of, for example, from about 400 to about 900 nanometers, and in particular from about 650 to about 850 nanometers, thus diode lasers can be selected as the light source.

REFERENCES

Illustrated in U.S. Pat. No. 7,312,007, the disclosure of which is totally incorporated herein by reference, is a photoconductive member containing a hole blocking layer, a photogenerating layer, and a charge transport layer, and wherein the hole blocking layer contains a metallic component like a titanium oxide and a polymeric binder.

Illustrated in U.S. Pat. No. 6,913,863, the disclosure of which is totally incorporated herein by reference, is a photoconductive imaging member comprised of an optional supporting substrate, a hole blocking layer thereover, a photogenerating layer, and a charge transport layer, and wherein the hole blocking layer is comprised of a metal oxide, a mixture of phenolic resins, and wherein at least one of the resins contains two hydroxy groups.

Illustrated in U.S. Pat. Nos. 6,255,027; 6,177,219, and 6,156,468, each of the disclosures thereof being totally incorporated herein by reference, are, for example, photoreceptors containing a charge blocking layer of a plurality of light scattering particles dispersed in a binder, reference for example, Example I of U.S. Pat. No. 6,156,468, wherein there is illustrated a charge blocking layer of titanium dioxide dispersed in a specific linear phenolic binder of VARCUM®, available from OxyChem Company.

Illustrated in U.S. Pat. No. 6,015,645, the disclosure of which is totally incorporated herein by reference, is a photoconductive imaging member comprised of a supporting substrate, a hole blocking layer, an optional adhesive layer, a photogenerating layer, and a charge transport layer, and wherein the blocking layer is comprised of a polyhaloalkylstyrene.

Layered photoconductors have been described in numerous U.S. patents, such as U.S. Pat. No. 4,265,990, the disclosure of which is totally incorporated herein by reference.

In U.S. Pat. No. 4,921,769, the disclosure of which is totally incorporated herein by reference, there are illustrated photoconductive imaging members with blocking layers of certain polyurethanes.

Illustrated in U.S. Pat. No. 5,473,064, the disclosure of which is totally incorporated herein by reference, is a process for the preparation of hydroxygallium phthalocyanine Type V, essentially free of chlorine.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments, which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water, concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

A number of photoconductors are disclosed in U.S. Pat. No. 5,489,496; U.S. Pat. No. 4,579,801; U.S. Pat. No. 4,518,669; U.S. Pat. No. 4,775,605; U.S. Pat. No. 5,656,407; U.S. Pat. No. 5,641,599; U.S. Pat. No. 5,344,734; U.S. Pat. No. 5,721,080; and U.S. Pat. No. 5,017,449, the entire disclosures of which are totally incorporated herein by reference. Also, photoreceptors are disclosed in U.S. Pat. No. 6,200,716; U.S. Pat. No. 6,180,309; and U.S. Pat. No. 6,207,334, the entire disclosures of which are totally incorporated herein by reference.

A number of undercoat or charge blocking layers are disclosed in U.S. Pat. No. 4,464,450; U.S. Pat. No. 5,449,573; U.S. Pat. No. 5,385,796; and U.S. Pat. No. 5,928,824.

SUMMARY

According to embodiments illustrated herein, there are provided photoconductors that enable, it is believed, acceptable print quality, and wherein ghosting is minimized or substantially eliminated in images printed in systems with high transfer current.

Embodiments disclosed herein also include a photoconductor comprising a substrate, an undercoat layer as illustrated herein disposed or deposited on the substrate, a photogenerating layer, and a charge transport layer formed on the photogenerating layer; a photoconductor comprised of a substrate, an undercoat layer disposed on the substrate, wherein the undercoat layer comprises a metal oxide like titanium dioxide, a polymer binder and a carbazole containing compound which primarily functions to provide for excellent cyclic stability for the photoconductor, thus color stability for xerographic prints transferred from on the photoconductor.

DETAILED DESCRIPTION

Aspects of the present disclosure relate to a photoconductor comprising a substrate; an undercoat layer thereover wherein the undercoat layer comprises a metal oxide, a polymer binder, and a carbazole containing compound; a photogenerating layer; and at least one charge transport layer, where at least one is, for example, from 1 to about 7, from 1 to about 5, from 1 to about 3, 1, or 2 layers; a photoconductor comprising a substrate; an undercoat layer thereover comprised of a mixture of a metal oxide, at least one resin binder, and a carbazole containing compound; a photogenerating layer; and a charge transport layer; a rigid drum or flexible photoconductor comprising in sequence a supporting substrate, a hole blocking layer comprised of a titanium oxide, at least one polymer binder, and a carbazole containing compound; a photogenerating layer; and a charge transport layer; a photoconductive member or device comprising a substrate, the robust undercoat layer illustrated herein, and at least one imaging layer, such as a photogenerating layer and a charge transport layer or layers, formed on the undercoat layer; a photoconductor wherein the photogenerating layer is situated between the charge transport layer and the substrate, and which layer contains a resin binder; an electrophotographic imaging member which generally comprises at least a substrate layer, an undercoat layer, and where the undercoat layer is generally located between the substrate and deposited on the undercoat layer in sequence a photogenerating layer and a charge transport layer; a photoconductor comprising a substrate; an undercoat layer thereover wherein the undercoat layer comprises a metal oxide, and at least one carbazole containing compound; a photogenerating layer; and at least one charge transport layer; a photoconductor comprising a substrate, an undercoat layer thereover comprised of a mixture of a metal oxide, a resin binder, and a carbazole containing compound; a photogenerating layer; and a charge transport layer; and a rigid, drum, or flexible photoconductor comprising in sequence a supporting substrate; a carbazole containing hole blocking layer; a photogenerating layer; and at least one charge transport layer; a photoconductor wherein the resin binder is comprised of a mixture of a first binder and a second binder; a photoconductor wherein the resin binder is present in an amount of from about 30 to about 85 weight percent, wherein the metal oxide is $TiO_2$, and wherein the carbazole compound is present in an amount of from about 0.5 to about 5 weight percent, and wherein the total of the undercoat layer components is about 100 percent; a photoconductor where the carbazole containing compound is 4-hydroxycarbazole, and where the resin binder is comprised of a melamine resin, and an acrylic polyol resin in a weight ratio of from about 35/65 to about 65/35; a photoconductor wherein the chemical attachment to the binder results from the bonding of the resin with the hydroxyl functional groups present on the carbazole; a photoconductor where the chemical attachment to the binder results from the bonding of the resin with the hydroxyl functional groups present on the hydroxyl carbazole; a photoconductor wherein the chemical attachment to the binder results from the bonding of the resin with the hydroxyl functional groups present on the 4-hydroxycarbazole, and the resin is a phenolic resin.

In embodiments, the undercoat layer metal oxide like $TiO_2$ can be either surface treated or untreated. Surface treatments include, but are not limited to, mixing the metal oxide with aluminum laurate, alumina, zirconia, silica, silane, methicone, dimethicone, sodium metaphosphate, and the like, and mixtures thereof. Examples of $TiO_2$ include MT-150W™ (surface treatment with sodium metaphosphate, available from Tayca Corporation), STR-60N™ (no surface treatment, available from Sakai Chemical Industry Co., Ltd.), FTL-100™ (no surface treatment, available from Ishihara Sangyo Laisha, Ltd.), STR-60™ (surface treatment with $Al_2O_3$, available from Sakai Chemical Industry Co., Ltd.), TTO-55N™ (no surface treatment, available from Ishihara Sangyo Laisha, Ltd.), TTO-55A™ (surface treatment with $Al_2O_3$, available from Ishihara Sangyo Laisha, Ltd.), MT-150AW™ (no surface treatment, available from Tayca Corporation), MT-150A™ (no surface treatment, available from Tayca Corporation), MT-100S™ (surface treatment with aluminum laurate and alumina, available from Tayca Corporation), MT-100HD™ (surface treatment with zirconia and alumina, available from Tayca Corporation), MT-100SA™ (surface treatment with silica and alumina, available from Tayca Corporation), and the like.

Examples of metal oxides present in suitable amounts, such as for example, from about 5 to about 80 weight percent, and more specifically, from about 40 to about 75 weight percent, are titanium oxides, and mixtures of metal oxides thereof. In embodiments, the metal oxide has a size diameter of from about 5 to about 300 nanometers, a powder resistance of from about $1\times10^3$ to about $6\times10^5$ ohm/cm when applied at a pressure of from about 50 to about 650 kilograms/$cm^2$, and yet more specifically, the titanium oxide possesses a primary particle size diameter of from about 10 to about 25 nanometers, and more specifically, from about 12 to about 17, and yet more specifically, about 15 nanometers with an estimated aspect ratio of from about 4 to about 5, and is optionally surface treated with, for example, a component containing, for example, from about 1 to about 3 percent by weight of alkali metal, such as a sodium metaphosphate, a powder resistance of from about $1\times10^4$ to about $6\times10^4$ ohm/cm when applied at a pressure of from about 650 to about 50 kilograms/$cm^2$; MT-150W™, and which titanium oxide is available from Tayca Corporation, and wherein the hole blocking layer is of a suitable thickness, such as a thickness of about from about 0.1 to about 15 microns, thereby avoiding or minimizing charge leakage. Metal oxide examples in addition to titanium are chromium, zinc, tin, copper, antimony, indium, and the like, and more specifically, zinc oxide, tin oxide, aluminum oxide, silicone oxide, zirconium oxide, indium oxide, molybdenum oxide, and mixtures thereof.

A number of carbazole containing compounds can be selected for the hole blocking or undercoat layer, including known suitable carbazole containing compounds inclusive of those substantially soluble in the solvent selected for deposition of the hole blocking layer.

Nonlimiting Examples of Carbazole Containing Compounds

Examples of carbazole compounds that may be selected for the undercoat or hole blocking layer are crosslinkable carbazoles with functional groups, such as hydroxyl, glycidyl, carboxyaldehyde, and the like, that can be crosslinked with the polymeric binder.

Specific nonlimiting examples of carbazole containing compounds selected include at least one of 4-hydroxycarbazole, 4-glycidyloxycarbazole, 9-benzylcarbazole-3,6-dicarboxaldehyde, 9-benzylcarbazole-3-carboxaldehyde, N-ethylcarbazole-3-carboxaldehyde, 9-(2-ethylhexyl)carbazole-3,6-dicarboxaldehyde, 9H-carbazole-9-ethanol, and 3-[(4-nitrophenyl)azo]-9H-carbazole-9-ethanol as represented, for example, by the following formulas/structures

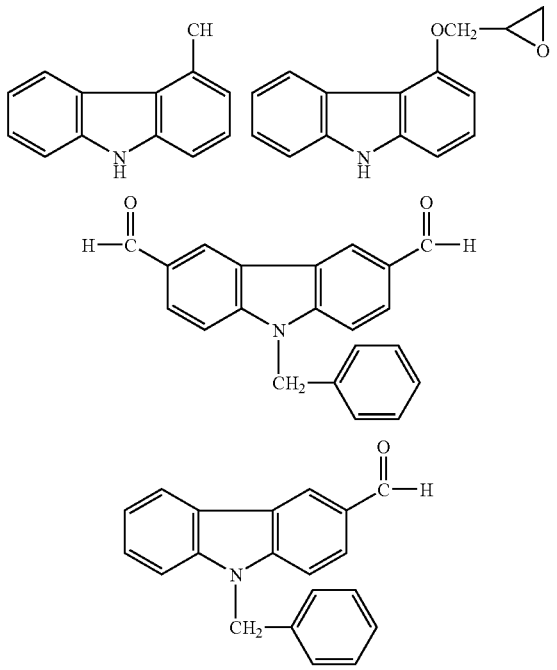

-continued

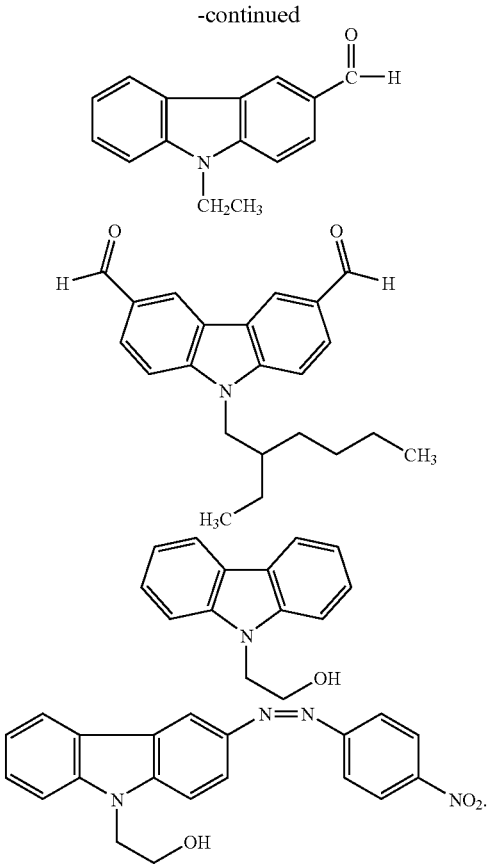

Other examples of carbazole compounds that may be selected for the undercoat or hole blocking layer are carbazoles free of or substantially free of crosslinkable functional groups.

Specific nonlimiting examples of carbazole containing compounds selected include at least one of N-ethylcarbazole, poly(N-vinylcarbazole), 1,2,3,4-tetrahydrocarbazole, 9-(1H-benzotriazol-1-ylmethyl)-9H-carbazole, 9-benzoylcarbazole, 9-ethylcarbazole-3-carboxaldehyde diphenylhydrazone, 9-ethylcarbazole-3-carboxaldehyde N-benzyl-N-phenylhydrazone, 9-phenylcarbazole, carbazole, and N-[(9-ethylcarbazol-3-yl)methylene]-2-methyl-1-indolinylamine.

The carbazole examples can be represented, for example, by the following formulas/structures

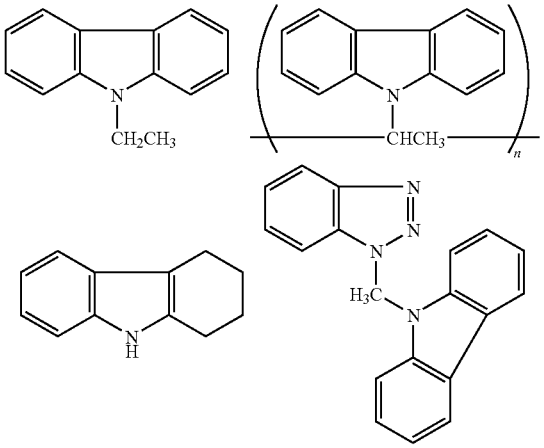

-continued

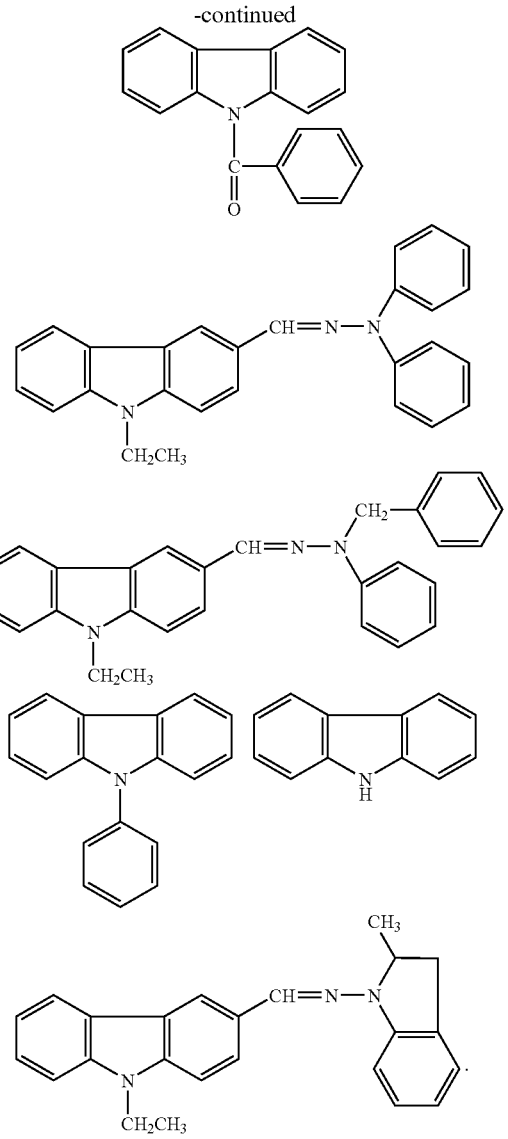

Examples of amounts of the carbazole containing compound that are present in the hole blocking layer can vary, and be, for example, from about 0.01 to about 30 weight percent, from about 0.1 to about 20 weight percent, and from about 0.5 to about 10 weight percent, and more specifically, from about 1 to about 5 weight percent, based on the weight percentages of the components contained in the hole blocking layer.

There can be further included in the undercoat or hole blocking layer a number of polymer binders, such as phenolic resins, polyol resins such as acrylic polyol resins, polyacetal resins such as polyvinyl butyral resins, polyisocyanate resins, aminoplast resins such as melamine resins or mixtures of these resins, and which resins or mixtures of resins function primarily to disperse the metal oxide, the carbazole containing compound, and other components that may be present in the undercoat.

Polymer Binder Examples

In embodiments, binder examples for the undercoat layer include acrylic polyol resins or acrylic resins, examples of which include copolymers of derivatives of acrylic and methacrylic acid including acrylic and methacrylic esters and compounds containing nitrile and amide groups, and other optional monomers. The acrylic esters can be selected from, for example, the group consisting of n-alkyl acrylates wherein alkyl contains in embodiments from 1 to about 25 carbon atoms, such as methyl, ethyl, propyl, butyl, pentyl, hexyl, heptyl, octyl, nonyl, decyl, dodecyl, tetradecyl, or hexadecyl acrylate; secondary and branched-chain alkyl acrylates such as isopropyl, isobutyl, sec-butyl, 2-ethylhexyl, or 2-ethylbutyl acrylate; olefinic acrylates such as allyl, 2-methylallyl, furfuryl, or 2-butenyl acrylate; aminoalkyl acrylates such as 2-(dimethylamino)ethyl, 2-(diethylamino)ethyl, 2-(dibutylamino)ethyl, or 3-(diethylamino)propyl acrylate; ether acrylates such as 2-methoxyethyl, 2-ethoxyethyl, tetrahydrofurfuryl, or 2-butoxyethyl acrylate; cycloalkyl acrylates such as cyclohexyl, 4-methylcyclohexyl, or 3,3,5-trimethylcyclohexyl acrylate; halogenated alkyl acrylates such as 2-bromoethyl, 2-chloroethyl, or 2,3-dibromopropyl acrylate; glycol acrylates and diacrylates such as ethylene glycol, propylene glycol, 1,3-propanediol, 1,4-butanediol, diethylene glycol, 1,5-pentanediol, triethylene glycol, dipropylene glycol, 2,5-hexanediol, 2,2-diethyl-1,3-propanediol, 2-ethyl-1,3-hexanediol, or 1,10-decanediol acrylate, and diacrylate. Examples of methacrylic esters can be selected from, for example, the group consisting of alkyl methacrylates such as methyl, ethyl, propyl, isopropyl, n-butyl, isobutyl, sec-butyl, t-butyl, n-hexyl, n-octyl, isooctyl, 2-ethylhexyl, n-decyl, or tetradecyl methacrylate; unsaturated alkyl methacrylates such as vinyl, allyl, oleyl, or 2-propynyl methacrylate; cycloalkyl methacrylates such as cyclohexyl, 1-methylcyclohexyl, 3-vinylcyclohexyl, 3,3,5-trimethylcyclohexyl, bornyl, isobornyl, or cyclopenta-2,4-dienyl methacrylate; aryl methacrylates such as phenyl, benzyl, or nonylphenyl methacrylate; hydroxyalkyl methacrylates such as 2-hydroxyethyl, 2-hydroxypropyl, 3-hydroxypropyl, or 3,4-dihydroxybutyl methacrylate; ether methacrylates such as methoxymethyl, ethoxymethyl, 2-ethoxyethoxymethyl, allyloxymethyl, benzyloxymethyl, cyclohexyloxymethyl, 1-ethoxyethyl, 2-ethoxyethyl, 2-butoxyethyl, 1-methyl-(2-vinyloxy)ethyl, methoxymethoxyethyl, methoxyethoxyethyl, vinyloxyethoxyethyl, 1-butoxypropyl, 1-ethoxybutyl, tetrahydrofurfuryl, or furfuryl methacrylate; oxiranyl methacrylates such as glycidyl, 2,3-epoxybutyl, 3,4-epoxybutyl, 2,3-epoxycyclohexyl, or 10,11-epoxyundecyl methacrylate; aminoalkyl methacrylates such as 2-dimethylaminoethyl, 2-diethylaminoethyl, 2-t-octylaminoethyl, N,N-dibutylaminoethyl, 3-diethylaminopropyl, 7-amino-3,4-dimethyloctyl, N-methylformamidoethyl, or 2-ureidoethyl methacrylate; glycol dimethacrylates such as methylene, ethylene glycol, 1,2-propanediol, 1,3-butanediol, 1,4-butanediol, 2,5-dimethyl-1,6-hexanediol, 1,10-decanediol, diethylene glycol, or triethylene glycol dimethacrylate; trimethacrylates such as trimethylolpropane trimethacrylate; carbonyl-containing methacrylates such as carboxymethyl, 2-carboxyethyl, acetonyl, oxazolidinylethyl, N-(2-methacryloyloxyethyl)-2-pyrrolidinone, N-methacryloyl-2-pyrrolidinone, N-(metharyloyloxy)formamide, N-methacryloylmorpholine, or tris(2-methacryloxyethyl)amine methacrylate; other nitrogen-containing methacrylates such as 2-methacryloyloxyethylmethyl cyanamide, methacryloyloxyethyl trimethylammonium chloride, N-(methacryloyloxy-ethyl) diisobutylketimine, cyanomethyl, or 2-cyanoethyl methacrylate; halogenated alkyl methacrylates such as chloromethyl, 1,3-dichloro-2-propyl, 4-bromophenyl, 2-bromoethyl, 2,3-dibromopropyl, or 2-iodoethyl methacrylate; sulfur-containing methacrylates such as methylthiol, butylthiol, ethylsulfonylethyl, ethylsulfinylethyl, thiocyanatomethyl, 4-thiocyanatobutyl, methylsulfinylmethyl, 2-dodecylthioethyl methacrylate, or bis(methacryloyloxyethyl) sulfide; phosphorous-boron-silicon-containing methacrylates such as 2-(ethylenephosphino)propyl, dimethylphosphinomethyl, dimethylphosphonoethyl, diethylphosphatoethyl, 2-(dimethylphosphato)propyl, 2-(dibutylphosphono)ethyl methacrylate, diethyl methacryloylphosphonate, dipropyl methacryloyl phosphate, diethyl methacryloyl phosphite, 2-methacryloyloxyethyl diethyl phosphite, 2,3-butylene methacryloyl-oxyethyl borate, or methyldiethoxymethacryloyloxyethoxysilane. Methacrylic amides and nitriles can be selected from the group consisting of at least one of N-methylmethacrylamide, N-isopropylmethacrylamide, N-phenylmethacrylamide, N-(2-hydoxyethyl) methacrylamide, 1-methacryloylamido-2-methyl-2-propanol, 4-methacryloylamido-4-methyl-2-pentanol, N-(methoxymethyl)methacrylamide, N-(dimethylaminoethyl) methacrylamide, N-(3-dimethylaminopropyl)methacrylamide, N-acetylmethacrylamide, N-methacryloylmalemic acid, methacryloylamido acetonitrile, N-(2-cyanoethyl) methacrylamide, 1-methacryloylurea, N-phenyl-N-phenylethylmethacrylamide, N-(3-dibutylaminopropyl)methacrylamide, N,N-diethylmethacrylamide, N-(2-cyanoethyl)-N-methylmethacrylamide, N,N-bis(2-diethylaminoethyl) methacrylamide, N-methyl-N-phenylmethacrylamide, N,N'-methylenebismethacrylamide, N,N'-ethylenebismethacrylamide, and N-(diethylphosphono) methacrylamide. Also, optional monomer examples are styrene, acrolein, acrylic anhydride, acrylonitrile, acryloyl chloride, methacrolein, methacrylonitrile, methacrylic anhydride, methacrylic acetic anhydride, methacryloyl chloride, methacryloyl bromide, itaconic acid, butadiene, vinyl chloride, vinylidene chloride, or vinyl acetate.

Further specific examples of acrylic polyol resins include PARALOID™ AT-410 (acrylic polyol, 73 percent in methyl amyl ketone, $T_g$=30° C., OH equivalent weight=880, acid number=25, $M_w$=9,000), AT-400 (acrylic polyol, 75 percent in methyl amyl ketone, $T_g$=15° C., OH equivalent weight=650, acid number=25, $M_w$=15,000), AT-746 (acrylic polyol, 50 percent in xylene, $T_g$=83° C., OH equivalent weight=1,700, acid number=15, $M_w$=45,000), AE-1285 (acrylic polyol, 68.5 percent in xylene/butanol=70/30, $T_g$=23° C., OH equivalent weight=1,185, acid number=49, $M_w$=6,500), and AT-63 (acrylic polyol, 75 percent in methyl amyl ketone, $T_g$=25° C., OH equivalent weight=1,300, acid number=30), all available from Rohm and Haas, Philadelphia, Pa.; JONCRYL™ 500 (styrene acrylic polyol, 80 percent in methyl amyl ketone, $T_g$=−5° C., OH equivalent weight=400), 550 (styrene acrylic polyol, 62.5 percent in PM-acetate/toluene=65/35, OH equivalent weight=600), 551 (styrene acrylic polyol, 60 percent in xylene, OH equivalent weight=600), 580 (styrene acrylic polyol, $T_g$=50° C., OH equivalent weight=350, acid number=10, $M_w$=15,000), 942 (styrene acrylic polyol, 73.5 percent in n-butyl acetate, OH equivalent weight=400), and 945 (styrene acrylic polyol, 78 percent in n-butyl acetate, OH equivalent weight=310), all available from Johnson Polymer, Sturtevant, Wis.; RU-1100-1k™ with a $M_n$ of 1,000 and 112 hydroxyl value, and RU-1550-k5™ with a $M_n$ of 5,000 and 22.5 hydroxyl value, both available from Procachem Corp.; G-CURE™ 108A70, available from Fitzchem Corp.; NEOL® polyol, available from BASF; TONE™ 0201 polyol with a $M_n$ of 530, a hydroxyl number of 117, and acid number of <0.25, available from Dow Chemical Company.

Examples of polyisocyanate binders include toluene diisocyanate (TDI), diphenylmethane 4,4'-diisocyanate (MDI), hexamethylene diisocyanate (HDI), isophorone diisocyanate (IPDI) based aliphatic, and aromatic polyisocyanates. MDI is also known as methylene bisphenyl isocyanate. Toluene diisocyanate (TDI), $CH_3(C_6H_3)(NCO)_2$, can be comprised of two common isomers, the 2,4 and the 2,6 diisocyanate; the pure (100 percent) 2,4 isomer is available and is used commercially, however, a number of TDIs are commercially available as 80/20 or 65/35 2,4/2,6 blends. Diphenylmethane 4,4' diisocyanate (MDI) is $OCN(C_6H_4)CH_2(C_6H_4)NCO$, and where the pure product has a functionality of 2; it is known to blend a pure (99+ percent) binder with mixtures of higher functionality MDI oligomers (often known as crude MDI) to create a range of functionalities/crosslinking characteristics. Hexamethylene diisocyanate (HDI) is $OCN(CH_2)_6NCO$, and isophorone diisocyanate (IPDI) is $OCNC_6H_7(CH_3)_3CH_2NCO$.

For blocked polyisocyanates, typical blocking agents include malonates, triazoles, ϵ-caprolactam, sulfites, phenols, ketoximes, pyrazoles, alcohols, and mixtures thereof; DESMODUR™ N3200 (aliphatic polyisocyanate resin based on HDI, 23 percent NCO content), N3300A (polyfunctional aliphatic isocyanate resin based on HDI, 21.8 percent NCO content), N75BA (aliphatic polyisocyanate resin based on HDI, 16.5 percent NCO content, 75 percent in n-butyl acetate), CB72N (aromatic polyisocyanate resin based on TDI, 12.3 to 13.3 percent NCO content, 72 percent in methyl n-amyl ketone), CB60N (aromatic polyisocyanate resin based on TDI, 10.3 to 11.3 percent NCO content, 60 percent in propylene glycol monomethyl ether acetate/xylene=5/3), CB601N (aromatic polyisocyanate resin based on TDI, 10 to 11 percent NCO content, 60 percent in propylene glycol monomethyl ether acetate), CB55N (aromatic polyisocyanate resin based on TDI, 9.4 to 10.2 percent NCO content, 55 percent in methyl ethyl ketone), BL4265SN (blocked aliphatic polyisocyanate resins based on IPDI, 8.1 percent blocked NCO content, 65 percent in aromatic 100), BL3475BA/SN (blocked aliphatic polyisocyanate resin based on HDI, 8.2 percent blocked NCO content, 75 percent in aromatic 100/n-butyl acetate=1/1), BL3370MPA (blocked aliphatic polyisocyanate resin based on HDI, 8.9 percent blocked NCO content, 70 percent in propylene glycol monomethyl ether acetate), BL3272MPA (blocked aliphatic polyisocyanate resin based on HDI, 10.2 percent blocked NCO content, 72 percent in propylene glycol monomethyl ether acetate), BL3175A (blocked aliphatic polyisocyanate resin based on HDI, 11.1 percent blocked NCO content, 75 percent in aromatic 100), MONDUR™ M (purified MDI supplied in flaked, fused or molten form), CD (modified MDI, liquid at room temperature, 29 to 30 percent NCO content), 582 (medium-functionality polymeric MDI, 32.2 percent NCO content), 448 (modified polymeric MDI prepolymer, 27.1 to 28.1 percent NCO content), 1441 (aromatic polyisocyanate based on MDI, 24.5 percent NCO content), 501 (MDI-terminated polyester prepolymer, 18.7 to 19.1 percent NCO content), all available from Bayer Polymers, Pittsburgh, Pa.

In embodiments, aminoplast resin binder for the UCL refers, for example, to a type of amino resin generated from a nitrogen-containing substance, and formaldehyde wherein the nitrogen-containing substance includes, for example, melamine, urea, benzoguanamine, and glycoluril. Melamine resins are considered amino resins prepared from melamine and formaldehyde. Melamine resins are known under various trade names, including but not limited to CYMEL®, BEETLE™, DYNOMIN™, BECKAMINE™, UFR™, BAKELITE™, ISOMIN™, MELAICAR™, MELBRITE™, MELMEX™, MELOPAS™, RESART™, and ULTRAPAS™. As used herein, urea resins are amino resins made from urea and formaldehyde. Urea resins are known under various trade names, including but not limited to CYMEL®, BEETLE™, UFRM™, DYNOMIN™, BECKAMINE™, and AMIREME™.

In various embodiments, the melamine resin binder for the UCL can be represented by

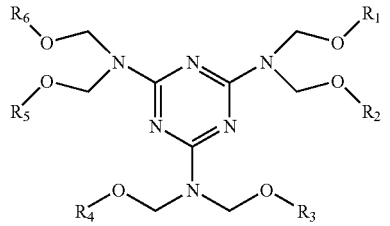

wherein $R_1$, $R_2$, $R_3$, $R_4$, $R_5$ and $R_6$ each independently represents a hydrogen atom or an alkyl chain with, for example, from 1 to about 8 carbon atoms, and more specifically, from 1 to about 4 carbon atoms. In embodiments, the melamine resin is water-soluble, dispersible or nondispersible. Specific examples of melamine resins include highly alkylated/alkoxylated, partially alkylated/alkoxylated, or mixed alkylated/alkoxylated; methylated, n-butylated or isobutylated; highly methylated melamine resins such as CYMEL®350, 9370; methylated high imino melamine resins (partially methylolated and highly alkylated) such as CYMEL® 323, 327; partially methylated melamine resins (highly methylolated and partially methylated) such as CYMEL®373, 370; high solids mixed ether melamine resins such as CYMEL® 1130, 324; n-butylated melamine resins such as CYMEL® 1151, 615; n-butylated high imino melamine resins such as CYMEL® 1158; and iso-butylated melamine resins such as CYMEL®255-10. CYMEL® melamine resins are commercially available from CYTEC Industries, Inc., and yet more specifically, the melamine resin may be selected from the group consisting of methylated formaldehyde-melamine resin, methoxymethylated melamine resin, ethoxymethylated melamine resin, propoxymethylated melamine resin, butoxymethylated melamine resin, hexamethylol melamine resin, alkoxyalkylated melamine resins such as methoxymethylated melamine resin, ethoxymethylated melamine resin, propoxymethylated melamine resin, butoxymethylated melamine resin, and mixtures thereof.

Urea UCL resin binder examples can be represented by

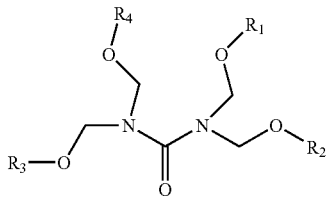

wherein $R_1$, $R_2$, $R_3$, and $R_4$ each independently represents a hydrogen atom, an alkyl chain with, for example, from 1 to about 8 carbon atoms, or with 1 to 4 carbon atoms, and which urea resin can be water soluble, dispersible or indispersible. The urea resin can be a highly alkylated/alkoxylated, partially alkylated/alkoxylated, or mixed alkylated/alkoxylated, and more specifically, the urea resin is a methylated, n-butylated, or isobutylated polymer. Specific examples of the urea resin include methylated urea resins such as CYMEL® U-65, U-382; n-butylated urea resins such as CYMEL® U-1054, UB-30-B; and isobutylated urea resins such as CYMEL® U-662, UI-19-I. CYMEL® urea resins are commercially available from CYTEC Industries, Inc.

Examples of UCL benzoguanamine binder resins can be represented by

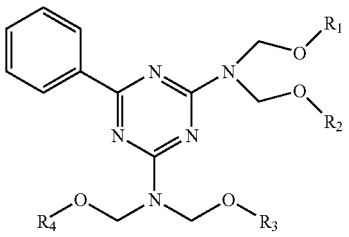

wherein $R_1$, $R_2$, $R_3$, and $R_4$ each independently represents a hydrogen atom or an alkyl chain as illustrated herein. In embodiments, the benzoguanamine resin is water soluble, dispersible, or indispersible. The benzoguanamine resin can be highly alkylated/alkoxylated, partially alkylated/alkoxylated, or a mixed alkylated/alkoxylated material. Specific examples of the benzoguanamine resin include methylated, n-butylated, or isobutylated, with examples of the benzoguanamine resin being CYMEL® 659, 5010, 5011. CYMEL® benzoguanamine resins are commercially available from CYTEC Industries, Inc. Benzoguanamine resin examples can be generally comprised of amino resins generated from benzoguanamine, and formaldehyde. Benzoguanamine resins are known with various identifiers, including but not limited to CYMEL®, BEETLE™, and UFORMITE™. Glycoluril resins are amino resins obtained from glycoluril and formaldehyde, and are known under various trade names, including but not limited to CYMEL®, and POWDERLINK™. The aminoplast resins can be highly alkylated or partially alkylated.

Glycoluril UCL resin binder examples are

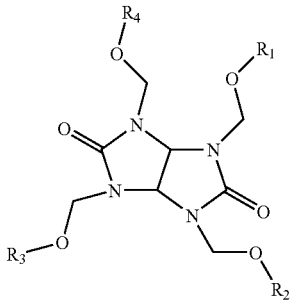

wherein $R_1$, $R_2$, $R_3$, and $R_4$ each independently represents a hydrogen atom or an alkyl chain as illustrated herein with, for example, 1 to about 8 carbon atoms, or with 1 to about 4 carbon atoms. The glycoluril resin can be water soluble, dispersible or indispersible. Examples of the glycoluril resin include highly alkylated/alkoxylated, partially alkylated/alkoxylated, or mixed alkylated/alkoxylated, and more specifically, the glycoluril resin can be methylated, n-butylated, or isobutylated. Specific examples of the glycoluril resin include CYMEL® 1170, 1171. CYMEL® glycoluril resins are commercially available from CYTEC Industries, Inc.

Phenolic UCL resin binders can be formed from the condensation products of an aldehyde with a phenol source in the presence of an acidic or basic catalyst. The phenol source may be, for example, phenol, alkyl-substituted phenols such as cresols and xylenols, halogen-substituted phenols such as chlorophenol, polyhydric phenols such as resorcinol or pyrocatechol, polycyclic phenols such as naphthol and bisphenol A, aryl-substituted phenols, cyclo-alkyl-substituted phenols, aryloxy-substituted phenols, and combinations thereof. The phenol source may be, for example, phenol, 2,6-xylenol, o-cresol, p-cresol, 3,5-xylenol, 3,4-xylenol, 2,3,4-trimethyl phenol, 3-ethyl phenol, 3,5-diethyl phenol, p-butyl phenol, 3,5-dibutyl phenol, p-amyl phenol, p-cyclohexyl phenol, p-octyl phenol, 3,5-dicyclohexyl phenol, p-phenyl phenol, p-crotyl phenol, 3,5-dimethoxy phenol, 3,4,5-trimethoxy phenol, p-ethoxy phenol, p-butoxy phenol, 3-methyl-4-methoxy phenol, p-phenoxy phenol, multiple ring phenols, such as bisphenol A, and combinations thereof. The aldehyde may be, for example, formaldehyde, paraformaldehyde, acetaldehyde, butyraldehyde, paraldehyde, glyoxal, furfuraldehyde, propinonaldehyde, benzaldehyde, and combinations thereof. The phenolic resin may be, for example, selected from dicyclopentadiene type phenolic resins, phenol novolak resins, cresol novolak resins, phenol aralkyl resins, and combinations thereof. U.S. Pat. Nos. 6,255,027; 6,177,219, and 6,156,468, the disclosures of which are totally incorporated herein by reference, illustrate examples of hole blocking layer of a plurality of light scattering particles dispersed in a binder such as a hole blocking layer of titanium dioxide dispersed in a specific linear phenolic binder of VARCUM® (available from OxyChem Company). Examples of phenolic resins include, but are not limited to, formaldehyde polymers with phenol, p-tert-butylphenol, and cresol, such as VARCUM™ 29159 and 29101 (OxyChem Co.), and DURITE™ 97 (Borden Chemical), or formaldehyde polymers with ammonia, cresol, and phenol, such as VARCUM™ 29112 (OxyChem Co.), or formaldehyde polymers with 4,4'-(1-methylethylidene) bisphenol, such as VARCUM™ 29108 and 29116 (OxyChem Co.), or formaldehyde polymers with cresol and phenol, such as VARCUM™ 29457 (OxyChem Co.), DURITE™ SD-423A, SD-422A (Borden Chemical), or formaldehyde polymers with phenol and p-tert-butylphenol, such as DURITE™ ESD 556C (Border Chemical).

The UCL phenolic resins can be modified to enhance certain properties. For example, the phenolic resins can be modified with suitable plasticizers including, but not limited to, polyvinyl butyral, polyvinyl formal, alkyds, epoxy resins, phenoxy resins (bisphenol A, epichlorohydrin polymer) polyamides, oils, and the like.

In embodiments, UCL polyacetal resin binders include polyvinyl butyrals, formed by the well-known reactions between aldehydes and alcohols. The addition of one molecule of an alcohol to one molecule of an aldehyde produces a hemiacetal. Hemiacetals are rarely isolated because of their inherent instability, but rather are further reacted with another molecule of alcohol to form a stable acetal. Polyvinyl acetals are prepared from aldehydes and polyvinyl alcohols. Polyvinyl alcohols are high molecular weight resins containing various percentages of hydroxyl and acetate groups produced by hydrolysis of polyvinyl acetate. The conditions of the acetal reaction and the concentration of the particular aldehyde and polyvinyl alcohol used are controlled to form polymers containing predetermined proportions of hydroxyl groups, acetate groups, and acetal groups.

The polyvinyl butyral UCL resin binder can be represented by

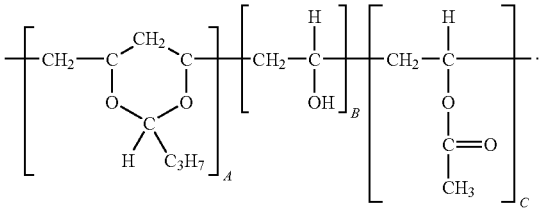

The proportions of polyvinyl butyral (A), polyvinyl alcohol (B), and polyvinyl acetate (C) are controlled, and are randomly distributed along the molecule. The mole percent of polyvinyl butyral (A) is, for example, from about 50 to about 95, that of polyvinyl alcohol (B) is, for example, from about 5 to about 30, and that of polyvinyl acetate (C) is, for example, from about 0 to about 10. In addition to vinyl butyral (A), other vinyl acetals can be optionally present in the molecule including vinyl isobutyral (D), vinyl propyral (E), vinyl acetacetal (F), and vinyl formal (G). The total mole percent of all the monomeric units in one molecule is about 100.

Examples of polyvinyl butyrals include BUTVAR™ B-72 ($M_w$=170,000 to 250,000, A=80, B=17.5 to 20, C=0 to 2.5), B-74 ($M_w$=120,000 to 150,000, A=80, B=17.5 to 20, C=0 to 2.5), B-76 ($M_w$=90,000 to 120,000, A=88, B=11 to 13, C=0 to 1.5), B-79 ($M_w$=50,000 to 80,000, A=88, B=10.5 to 13, C=0 to 1.5), B-90 ($M_w$=70,000 to 100,000, A=80, B=18 to 20, C=0 to 1.5), and B-98 ($M_w$=40,000 to 70,000, A=80, B=18 to 20, C=0 to 2.5), all commercially available from Solutia, St. Louis, Mo.; S-LEC™ BL-1 (degree of polymerization=300, A=63±3, B=37, C=3), BM-1 (degree of polymerization=650, A=65±3, B=32, C=3), BM-S (degree of polymerization=850, A>=70, B=25, C=4 to 6), BX-2 (degree of polymerization=1,700, A=45, B=33, G=20), all commercially available from Sekisui Chemical Co., Ltd., Tokyo, Japan.

The hole blocking layer can contain a single resin binder, a mixture of resin binders, such as from 2 to about 7, and the like, and where for the mixtures the percentage amounts selected for each resin varies providing that the mixture contains about 100 percent by weight of the first and second resin, or the first, second, and third resin.

The hole blocking layer can, in embodiments, be prepared by a number of known methods, the process parameters being dependent, for example, on the photoconductor member desired. The hole blocking layer can be coated as a solution or a dispersion onto a substrate by the use of a spray coater, dip coater, extrusion coater, roller coater, wire-bar coater, slot coater, doctor blade coater, gravure coater, and the like, and dried at from about 40° C. to about 200° C. for a suitable period of time, such as from about 1 minute to about 10 hours, under stationary conditions or in an air flow. The coating can be accomplished to provide a final coating thickness of from about 0.1 to about 30 microns, or from about 0.5 to about 15 microns after drying. Also disclosed is the incorporation of the carbazole containing compound into the prepared hole blocking layer dispersion, and where the carbazole compound is substantially soluble in the prepared dispersion, and wherein the resulting dispersion was stable, that is it retained its characteristics, for a number of weeks.

In embodiments, the undercoat layer may contain various colorants such as organic pigments and organic dyes, including, but not limited to, azo pigments, quinoline pigments, perylene pigments, indigo pigments, thioindigo pigments, bisbenzimidazole pigments, phthalocyanine pigments, quinacridone pigments, quinoline pigments, lake pigments, azo lake pigments, anthraquinone pigments, oxazine pigments, dioxazine pigments, triphenylmethane pigments, azulenium dyes, squalium dyes, pyrylium dyes, triallylmethane dyes, xanthene dyes, thiazine dyes, and cyanine dyes. In various embodiments, the undercoat layer may include inorganic materials, such as amorphous silicon, amorphous selenium, tellurium, a selenium-tellurium alloy, cadmium sulfide, antimony sulfide, titanium oxide, tin oxide, zinc oxide, and zinc sulfide, and mixtures thereof. The colorant can be selected in various suitable amounts like from about 0.5 to about 20 weight percent, and more specifically, from 1 to about 12 weight percent.

Photoconductor Layer Examples

The thickness of the photoconductive substrate layer depends on many factors including economical considerations, electrical characteristics, and the like; thus, this layer may be of a substantial thickness, for example over 3,000 microns, such as from about 500 to about 2,000, from about 300 to about 700 microns, or of a minimum thickness. In embodiments, the thickness of this layer is from about 75 microns to about 300 microns, or from about 100 to about 150 microns.

The substrate may be opaque, substantially transparent, and may comprise any suitable material having the required mechanical properties. Accordingly, the substrate may comprise a layer of an electrically nonconductive or conductive material such as an inorganic or an organic composition. As electrically nonconducting materials, there may be selected various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors including strength desired and economical considerations. For a drum, as disclosed in a copending application referenced herein, this layer may be of a substantial thickness of, for example, up to many centimeters or of a minimum thickness of less than a millimeter. Similarly, a flexible belt may be of a substantial thickness of, for example, about 250 micrometers, or of a minimum thickness of less than about 50 micrometers, provided there are no adverse effects on the final electrophotographic device. In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, substrates selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The photogenerating layer in embodiments is comprised of, for example, a number of know photogenerating pigments including, for example, Type V hydroxygallium phthalocyanine, Type IV or V titanyl phthalocyanine or chlorogallium phthalocyanine, and a resin binder like poly(vinyl chloride-co-vinyl acetate) copolymer, such as VMCH (available from Dow Chemical), or polycarbonate. Generally, the photogenerating layer can contain known photogenerating pigments, such as metal phthalocyanines, metal free phthalocyanines, alkylhydroxygallium phthalocyanines, hydroxygallium phthalocyanines, chlorogallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 micron to about 10 microns, and more specifically, from about 0.25 micron to about 2 microns when, for example, the photogenerating compositions are present in an amount of from about 30 to about 75 percent by volume. The maximum thickness of this layer in embodiments is dependent primarily upon factors, such as photosensitivity, electrical properties, and mechanical considerations. The photogenerating layer binder resin is present in various suitable amounts of, for example, from about 1 to about 50, and more specifically, from about 1 to about 10 weight percent, and which resin may be selected from a number of known polymers, such as poly(vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Generally, however, from about 5 percent by volume to about 90 percent by volume of the photogenerating pigment is dispersed in about 10 percent by volume to about 95 percent by volume of the resinous binder, or from about 20 percent by volume to about 30 percent by volume of the photogenerating pigment is dispersed in about 70 percent by volume to about 80 percent by volume of the resinous binder composition. In one embodiment, about 8 percent by volume of the photogenerating pigment is dispersed in about 92 percent by volume of the resinous binder composition. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like, hydrogenated amorphous silicone and compounds of silicone and germanium, carbon, oxygen, nitrogen, and the like fabricated by vacuum evaporation or deposition. The photogenerating layer may also comprise inorganic pigments of crystalline selenium and its alloys; Groups II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos, and the like dispersed in a film forming polymeric binder and fabricated by solvent coating techniques.

Examples of polymeric binder materials that can be selected as the matrix for the photogenerating layer components are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrene-butadiene copolymers, vinylidene chloride-vinyl chloride copolymers, vinyl acetate-vinylidene chloride copolymers, styrene-alkyd resins, poly(vinyl carbazole), and the like. These polymers may be block, random, or alternating copolymers.

Various suitable and conventional known processes may be selected to mix, and thereafter apply the photogenerating layer coating mixture to the substrate, and more specifically, to the hole blocking layer or other layers like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like. The coating of the photogenerating layer on the UCL (undercoat layer) in embodiments of the present disclosure can be accomplished such that the final dry thickness of the photogenerating layer is as illustrated herein, and can be, for example, from about 0.01 to about 30 microns after being dried at, for example, about 40° C. to about 150° C. for about 1 to about 90 minutes. More specifically, a photogenerating layer of a thickness, for example, of from about 0.1 to about 30, or from about 0.5 to about 2 microns can be applied to or deposited on the substrate, on other surfaces in between the substrate and the charge transport layer, and the like. The hole blocking layer or UCL may be applied to the electrically conductive supporting substrate surface prior to the application of a photogenerating layer.

A suitable known adhesive layer can be included in the photoconductor. Typical adhesive layer materials include, for example, polyesters, polyurethanes, and the like. The adhesive layer thickness can vary, and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like. As optional adhesive layers usually in contact with or situated between the hole blocking layer and the photogenerating layer, there can be selected various known substances inclusive of copolyesters, polyamides, poly(vinyl butyral), poly(vinyl alcohol), polyurethane, and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicone nitride, carbon black, and the like, to provide, for example, in embodiments of the present disclosure, further desirable electrical and optical properties.

A number of charge transport materials, especially known hole transport molecules, may be selected for the charge transport layer, examples of which are aryl amines of the formulas/structures, and which layer is generally of a thickness of from about 5 microns to about 75 microns, and more specifically, of a thickness of from about 10 microns to about 40 microns

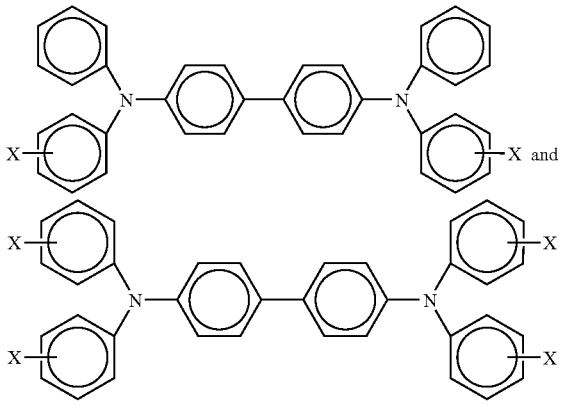

and wherein X is a suitable hydrocarbon like alkyl, alkoxy, and aryl; a halogen, or mixtures thereof, and especially those substituents selected from the group consisting of Cl and $CH_3$; and molecules of the following formulas

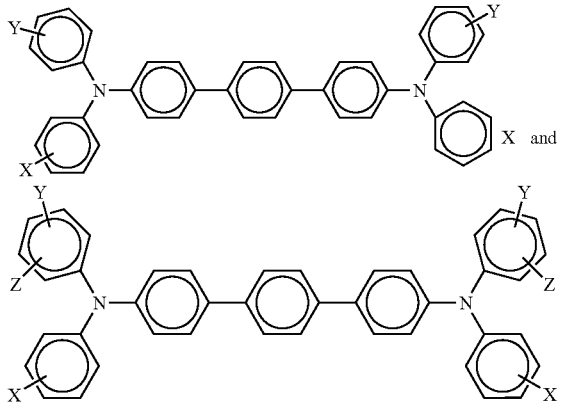

and wherein X, Y and Z are a suitable substituent like a hydrocarbon, such as independently alkyl, alkoxy, or aryl; a halogen, or mixtures thereof, and in embodiments wherein at least one of Y or Z is present. Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments. At least one charge transport refers, for example, to 1, from 1 to about 7, from 1 to about 4, and from 1 to about 2.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

Examples of the binder materials selected for the charge transport layer or layers include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly(4,4'-isopropylidene-diphenylene)carbonate (also referred to as bisphenol-A-polycarbonate), poly(4,4'-cyclohexylidine diphenylene)carbonate (also referred to as bisphenol-Z-polycarbonate), poly(4,4'-isopropylidene-3,3'-dimethyl-diphenyl) carbonate (also referred to as bisphenol-C-polycarbonate), and the like. In embodiments, electrically inactive binders are comprised of polycarbonate resins with a weight average molecular weight of from about 20,000 to about 100,000, or with a molecular weight $M_w$ of from about 50,000 to about 100,000 preferred. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of hole transporting molecules selected for the charge transport layer or layers, and present in various effective amounts in a suitable polymer include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine; hydrazones such as N-phenyl-N-methyl-3-(9-ethyl)carbazyl hydrazone, and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. A small molecule charge transporting compound that permits injection of holes into the photogenerating layer with high efficiency, and transports them across the charge transport layer with short transit times includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. If desired, the charge transport material in the charge transport layer may comprise a polymeric charge transport material or a combination of a small molecule charge transport material and a polymeric charge transport material.

A number of processes may be used to mix, and thereafter apply the charge transport layer or layers coating mixture to the photogenerating layer. Typical application techniques include spraying, dip coating, and roll coating, wire wound rod coating, and the like. Drying of the charge transport deposited coating may be effected by any suitable conventional technique such as oven drying, infrared radiation drying, air drying, and the like.

The thickness of each of the charge transport layers in embodiments is, for example, from about 10 to about 75, from about 15 to about 50 micrometers, but thicknesses outside these ranges may in embodiments also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to about 200:1, and in some instances 400:1. The charge transport layer is substantially nonabsorbing to visible light or radiation in the region of intended use, but is electrically "active" in that it allows the injection of photogenerated holes from the photoconductive layer or photogenerating layer, and allows these holes to be transported through itself to selectively discharge a surface charge on the surface of the active layer.

The thickness of the continuous charge transport layer selected depends upon the abrasiveness of the charging (bias charging roll), cleaning (blade or web), development (brush), transfer (bias transfer roll), and the like in the system employed, and can be up to about 10 micrometers. In embodiments, the thickness for each charge transport layer can be, for example, from about 1 micrometer to about 5 micrometers. Various suitable and conventional methods may be used to mix, and thereafter apply an overcoat top charge transport layer coating mixture to the photoconductor. Typical application techniques include spraying, dip coating, roll coating, wire wound rod coating, and the like. Drying of the deposited coating may be effected by any suitable conventional technique, such as oven drying, infrared radiation drying, air drying, and the like. The dried overcoat layer of this disclosure should transport holes during imaging, and should not have too high a free carrier concentration. Free carrier concentration in the overcoat increases the dark decay.

Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl) phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20, from about 1 to about 10, or from about 3 to about 8 weight percent.

The following Examples are provided. All proportions are by weight unless otherwise indicated.

Comparative Example 1

A dispersion of a hole blocking layer was prepared by milling 18 grams of $TiO_2$ (MT-150W, manufactured by Tayca Co., Japan), 24 grams of the phenolic resin (VARCUM® 29159, OxyChem Co.) at a solid weight ratio of about 60 to about 40 in a solvent mixture of xylene and 1-butanol (50/50 mixture), and a total solid content of about 52 percent in an attritor mill with about 0.4 to about 0.6 millimeter size $ZrO_2$ beads for 6.5 hours, and then filtering with a 20 μm Nylon filter. To the resulting dispersion was then added methyl isobutyl ketone in a solvent mixture of xylene, and 1-butanol at a weight ratio of 47.5:47.5:5 (xylene/butanol/ketone). A 30 millimeter aluminum drum substrate was then coated with the aforementioned generated dispersion using known coating techniques as illustrated herein. After drying a hole blocking layer of $TiO_2$ in the phenolic resin ($TiO_2$/phenolic resin=60/40) at 160° C. for 20 minutes, about 10 microns in thickness were obtained.

A photogenerating layer, about 0.2 micron in thickness, and comprising the known pigment chlorogallium phthalocyanine (Type B), was deposited on the above hole blocking layer or undercoat layer. The photogenerating layer coating dispersion was prepared as follows. 2.7 Grams of chlorogallium phthalocyanine (ClGaPc) Type B pigment were mixed with 2.3 grams of the polymeric binder (carboxyl-modified vinyl copolymer, VMCH, Dow Chemical Company), 15 grams of n-butyl acetate, and 30 grams of xylene. The resulting mixture was milled in an attritor mill with about 200 grams of 1-millimeter Hi-Bea borosilicate glass beads for about 3 hours. The dispersion mixture obtained was then filtered through a 20 μm Nylon cloth filter, and the solids content of the dispersion was diluted to about 6 weight percent.

Subsequently, a 32 micron charge transport layer was coated on top of the photogenerating layer from a dispersion prepared from N,N'-diphenyl-N,N-bis(3-methylphenyl)-1,1'-biphenyl-4,4'-diamine (5.38 grams), a film forming polymer binder PCZ 400 [poly(4,4'-dihydroxy-diphenyl-1-1-cyclohexane, $M_w$=40,000)] available from Mitsubishi Gas Chemical Company, Ltd. (7.13 grams), and PTFE POLYFLON™ L-2 microparticle (1 gram) available from Daikin Industries dissolved/dispersed in a solvent mixture of 20 grams of tetrahydrofuran (THF) and 6.7 grams of toluene via a CAVIPRO™ 300 nanomizer (Five Star Technology, Cleveland, Ohio). The charge transport layer was dried at about 120° C. for about 40 minutes.

Example I

A photoconductor was prepared by repeating the process of Comparative Example 1 except that 1 weight percent of 4-hydroxycarbazole was added into the hole blocking layer dispersion of Comparative Example 1, followed by mixing for 8 hours. A 30 millimeter in diameter aluminum drum substrate was coated, using known coating techniques, with the aforementioned formed dispersion. After drying at 160° C. for 20 minutes, a hole blocking layer of $TiO_2$ and 4-hydroxycarbazole in the phenolic resin ($TiO_2$/phenolic resin/4-hydroxycarbazole=59.4/39.6/1), about 10 microns in thickness, was obtained.

Example II

A number of photoconductors are prepared by repeating the process of Comparative Example 1 except that the hole blocking layer could include, in place of the 4-hydroxycarbazole, 1 weight percent of 4-glycidyloxycarbazole, 9-benzylcarbazole-3,6-dicarboxaldehyde, 9-benzylcarbazole-3-carboxaldehyde, N-ethylcarbazole-3-carboxaldehyde, 9-(2-ethylhexyl)carbazole-3,6-dicarboxaldehyde, 9H-carbazole-9-ethanol, or 3-[(4-nitrophenyl)azo]-9H-carbazole-9-ethanol, N-ethylcarbazole, poly(N-vinylcarbazole), 1,2,3,4-tetrahydrocarbazole, 9-(1H-benzotriazol-1-ylmethyl)-9H-carbazole, 9-benzoylcarbazole, 9-ethylcarbazole-3-carboxaldehyde diphenylhydrazone, 9-ethylcarbazole-3-carboxaldehyde N-benzyl-N-phenylhydrazone, 9-phenylcarbazole, or N-[(9-ethylcarbazol-3-yl)methylene]-2-methyl-1-indolinylamine.

Electrical Property Testing

The above prepared photoconductors of Comparative Example 1 and Example I were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic (PIDC) curves from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. These two photoconductors were tested at surface potentials of 700 volts with the exposure light intensity incrementally increased by regulating a series of neutral density filters; the exposure light source was a 780 nanometer light emitting diode. The xerographic simulation was completed in an environmentally controlled light tight chamber at dry conditions (10 percent relative humidity and 22° C.).

The photoconductors of Comparative Example 1 and Example I exhibited substantially similar PIDCs. Incorporation of the carbazole containing compound into the hole blocking or undercoat layer did not adversely affect the electrical properties of the photoconductor.

Cyclic Stability Testing

The above-prepared photoconductors of Comparative Example 1 and Example I were tested for cyclic stability by using an in-house high-speed Hyper Mode Test (HMT) at warm and humid conditions (80 percent relative humidity and 80° F.). The HMT fixture rotated the drum photoconductors at 150 rpm under a Scoroton set to −700 volts then exposed the drum with a LED erase lamp. Two voltage probes were positioned 90 degrees apart to measure $V_{high}$ ($V_H$) and $V_{Residual}$ ($V_L$) with nonstop 400 kilo charge/discharge/erase cycling numbers. The ozone that was produced during cycling was evacuated out of the chamber by means of an air pump and ozone filter.

The HMT cycling results are shown in Table 2.

TABLE 2

| | | HMT Cycles | | | | |
|---|---|---|---|---|---|---|
| | | 100 | 100,000 | 200,000 | 300,000 | 400,000 |
| Comparative | $V_H$ (V) | 700 | 698 | 695 | 699 | 700 |
| Example 1 | $V_L$ (V) | 30 | 109 | 134 | 145 | 150 |
| Example I | $V_H$ (V) | 700 | 698 | 698 | 700 | 697 |
| | $V_L$ (V) | 34 | 57 | 54 | 46 | 50 |

After a continuous 400 kilocycles, $V_H$ for both photoconductors (Comparative Example 1 and Example I) remained almost unchanged. However, $V_L$ cycle up was about 120 volts (from 30 volts to 150 volts) for the photoconductor of Comparative Example 1, and about 16 volts (from 34 volts to 50 volts) for the photoconductor of Example I with the incorporation of the carbazole containing compound into the hole blocking layer. The $V_L$ cycle up of the disclosed photoconductor Example I was only about one eighth of that of the photoconductor of Comparative Example 1. Incorporation of the carbazole containing compound into the hole blocking layer thus improved cyclic stability of the photoconductor.

It is believed that improved cyclic stability of the photoconductor would improve color print stability of the developed images generated on the photoconductor, especially as applicable to xerographic images and prints.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a substrate; an undercoat layer thereover wherein the undercoat layer comprises a metal oxide is present in an amount of from about 20 percent to about 80 percent by weight and a carbazole containing compound is present in an amount of from about 0.01 to about 30 weight percent, and wherein the total of said components in said undercoat layer is about 100 percent; a photogenerating layer, and a charge transport layer.

2. A photoconductor in accordance with claim 1 wherein said undercoat layer further includes at least one polymer binder, and wherein said carbazole is chemically attached to said binder.

3. A photoconductor in accordance with claim 1 wherein said metal oxide is a titanium oxide.

4. A photoconductor in accordance with claim 1 wherein said metal oxide is present in an amount of from about 20 percent to about 80 percent by weight of the total weight of the undercoat layer components, and further which undercoat layer includes at least one resin binder.

5. A photoconductor in accordance with claim 1 wherein said carbazole containing compound is present in said undercoat layer in an amount of from about 0.1 to about 20 weight percent.

6. A photoconductor in accordance with claim 1 wherein said carbazole containing compound is present in said undercoat layer in an amount of from about 1 to about 5 weight percent.

7. A photoconductor in accordance with claim 1 wherein said carbazole is selected from the group consisting of at least one of 4-hydroxycarbazole, 4-glycidyloxycarbazole, 9-benzylcarbazole-3,6-dicarboxaldehyde, 9-benzylcarbazole-3-carboxaldehyde, N-ethylcarbazole-3-carboxaldehyde, 9-(2-ethylhexyl)carbazole-3,6-dicarboxaldehyde, 9H-carbazole-9-ethanol, 3-[(4-nitrophenyl)azo]-9H-carbazole-9-ethanol, N-ethylcarbazole, poly(N-vinylcarbazole), 1,2,3,4-tetrahydrocarbazole, 9-(1H-benzotriazol-1-ylmethyl)-9H-carbazole, 9-benzoylcarbazole, 9-ethylcarbazole-3-carboxaldehyde diphenylhydrazone, 9-ethylcarbazole-3-carboxaldehyde N-benzyl-N-phenylhydrazone, 9-phenylcarbazole, carbazole, and N-[(9-ethylcarbazol-3-yl) methylene]-2-methyl-1-indolinylamine.

8. A photoconductor in accordance with claim 1 wherein said carbazole is represented by at least one of the following

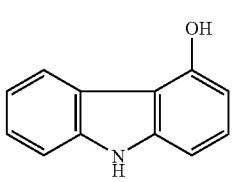

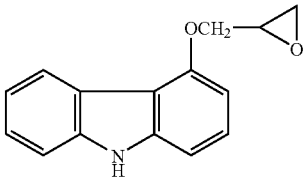

-continued

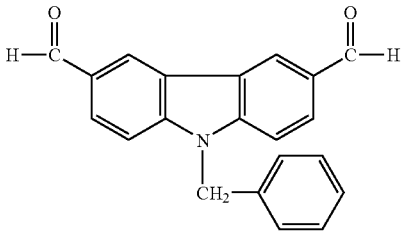

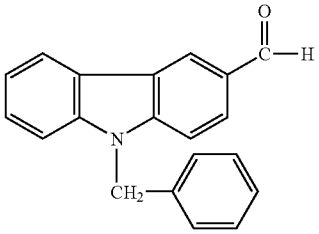

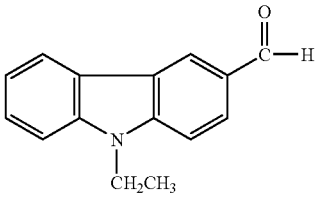

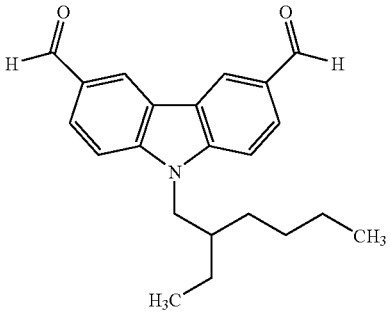

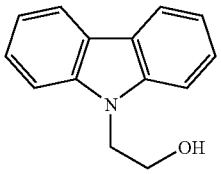

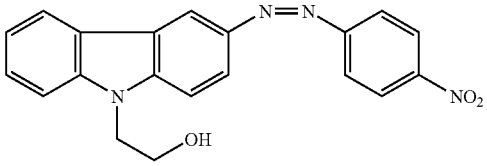

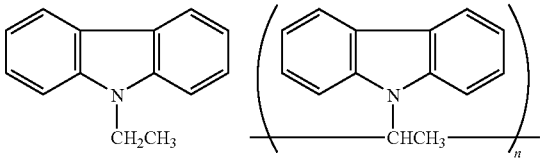

-continued

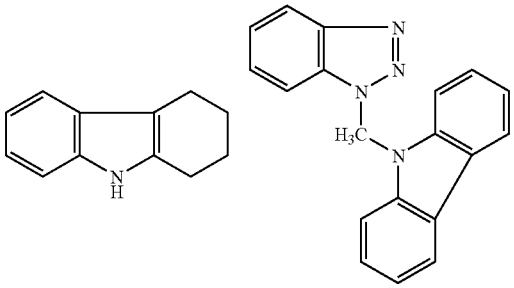

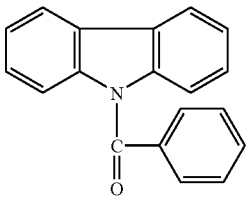

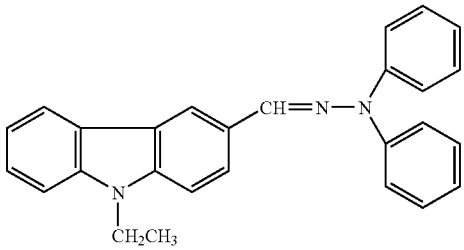

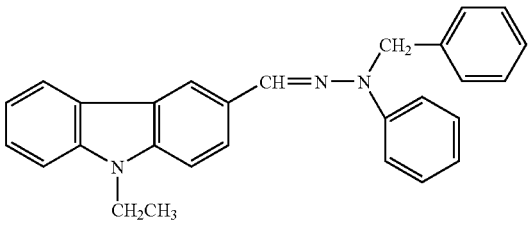

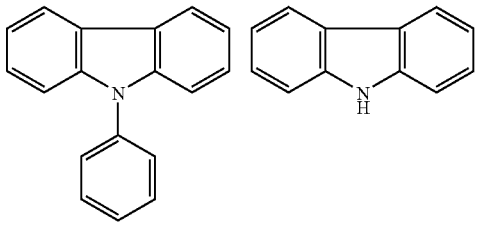

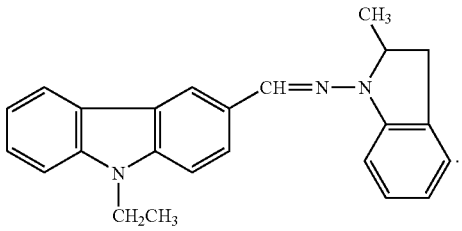

9. A photoconductor in accordance with claim 1 wherein said carbazole is

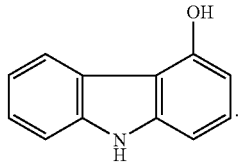

10. A photoconductor in accordance with claim 1 wherein said carbazole is a hydroxycarbazole.

11. A photoconductor in accordance with claim 1 wherein said carbazole is 4-hydroxycarbazole present in an amount of from about 1 to about 5 weight percent.

12. A photoconductor in accordance with claim 11 wherein said carbazole is present in an amount of from about 0.5 to about 3 weight percent.

13. A photoconductor in accordance with claim 1 wherein said metal oxide is present in an amount of from about 30 percent to about 70 percent based on the total weight of the undercoat layer components.

14. A photoconductor in accordance with claim 1 wherein said metal oxide possesses a size diameter of from about 5 to about 300 nanometers, and a powder resistivity of from about $1\times10^3$ to about $1\times10^8$ ohm/cm when applied at a pressure of from about 50 to about 650 kilograms/cm$^2$.

15. A photoconductor in accordance with claim 1 wherein said metal oxide is surface treated with aluminum laurate, alumina, zirconia, silica, silane, methicone, dimethicone, an alkali metaphosphate, or mixtures thereof.

16. A photoconductor in accordance with claim 1 wherein the thickness of the undercoat layer is from about 0.1 micron to about 30 microns.

17. A photoconductor in accordance with claim 1 wherein said charge transport layer is comprised of at least one of

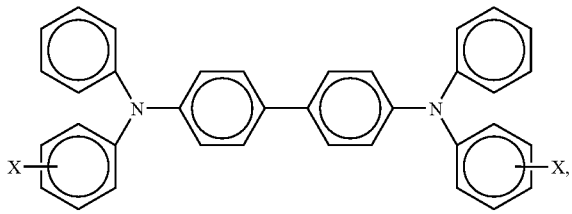

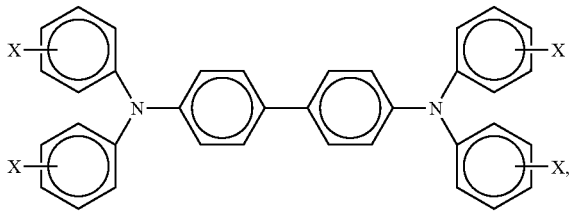

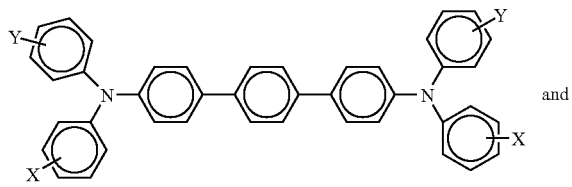

and

-continued

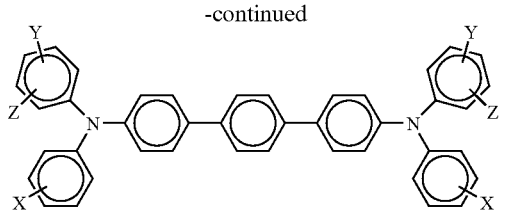

wherein X, Y, and Z are independently selected from the group consisting of alkyl, alkoxy, aryl, halogen, and mixtures thereof, and said carbazole is selected from the group consisting of at least one of 4-hydroxycarbazole, 4-glycidyloxycarbazole, 9-benzylcarbazole-3,6-dicarboxaldehyde, 9-benzylcarbazole-3-carboxaldehyde, N-ethylcarbazole-3-carboxaldehyde, 9-(2-ethylhexyl) carbazole-3,6-dicarboxaldehyde, 9H-carbazole-9-ethanol, 3-[(4-nitrophenyl)azo]-9H-carbazole-9-ethanol, N-ethylcarbazole, poly(N-vinylcarbazole), 1,2,3,4-tetrahydrocarbazole, 9-(1H-benzotriazol-1-ylmethyl)-9H-carbazole, 9-benzoylcarbazole, 9-ethylcarbazole-3-carboxaldehyde diphenylhydrazone, 9-ethylcarbazole-3-carboxaldehyde N-benzyl-N-phenylhydrazone, 9-phenylcarbazole, carbazole, and N-[(9-ethylcarbazol-3-yl)methylene]-2-methyl-1-indolinylamine, and wherein said carbazole is present in an amount of from about 1 to about 7 weight percent, and said undercoat layer has a thickness of from about 5 to about 15 microns.

18. A photoconductor in accordance with claim 1 wherein said charge transport layer is comprised of a component selected from the group consisting of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, and said carbazole, present in an amount of from about 1 to about 7 weight percent, is selected from the group consisting of at least one of 4-hydroxycarbazole, 4-glycidyloxycarbazole, 9-benzylcarbazole-3,6-dicarboxaldehyde, 9-benzylcarbazole-3-carboxaldehyde, N-ethylcarbazole-3-carboxaldehyde, 9-(2-ethylhexyl)carbazole-3,6-dicarboxaldehyde, 9H-carbazole-9-ethanol, 3-[(4-nitrophenyl)azo]-9H-carbazole-9-ethanol, N-ethylcarbazole, poly(N-vinylcarbazole), 1,2,3,4-tetrahydrocarbazole, 9-(1H-benzotriazol-1-ylmethyl)-9H-carbazole, 9-benzoylcarbazole, 9-ethylcarbazole-3-carboxaldehyde diphenylhydrazone, 9-ethylcarbazole-3-carboxaldehyde N-benzyl-N-phenylhydrazone, 9-phenylcarbazole, carbazole, and N-[(9-ethylcarbazol-3-yl)methylene]-2-methyl-1-indolinylamine.

19. A photoconductor in accordance with claim 1 wherein said photogenerating layer is comprised of at least one photogenerating pigment.

20. A photoconductor in accordance with claim 19 wherein said photogenerating pigment is comprised of at least one of a titanyl phthalocyanine, a hydroxygallium phthalocyanine, a halogallium phthalocyanine, a bisperylene, and mixtures thereof.

21. A photoconductor in accordance with claim 1 wherein said charge transport layer is comprised of a charge transport component and a resin binder, and wherein said photogenerating layer is comprised of at least one photogenerating pigment and a resin binder; and wherein said photogenerating layer is situated between said substrate and said charge transport layer; said carbazole, present in an amount of from about 1 to about 8 weight percent, is selected from the group consisting of at least one of 4-hydroxycarbazole, 4-glycidyloxycarbazole, 9-benzylcarbazole-3,6-dicarboxaldehyde, 9-benzylcarbazole-3-carboxaldehyde, N-ethylcarbazole-3-carboxaldehyde, 9-(2-ethylhexyl)carbazole-3,6-dicarboxaldehyde, 9H-carbazole-9-ethanol, 3-[(4-nitrophenyl)azo]-9H-carbazole-9-ethanol, and N-ethylcarbazole.

22. A photoconductor comprising a substrate; a layer thereover comprised of a mixture of a metal oxide is present in an amount of from about 20 percent to about 80 percent by weight, at least one polymer, and a carbazole containing compound is present in an amount of from about 0.01 to about 30 weight percent, and wherein the total of said components in said undercoat layer is about 100 percent, and wherein said carbazole is chemically attached to said resin binder; a photogenerating layer; and at least one charge transport layer.

23. A rigid drum or flexible photoconductor comprising in sequence a supporting substrate; a layer thereover comprised of a metal oxide is present in an amount of from about 20 percent to about 80 percent by weight, at least one polymer, and an carbazole containing compound is present in an amount of from about 0.01 to about 30 weight percent, and wherein the total of said components in said undercoat layer is about 100 percent; a photogenerating layer; and a charge transport layer.

24. A photoconductor in accordance with claim 22 wherein said polymer is selected from the group consisting of phenolic resins, polyol resins, acrylic polyol resins, polyacetal resins, polyvinyl butyral resins, polyisocyanate resins, aminoplast resins, melamine resins, and mixtures thereof.

25. A photoconductor in accordance with claim 23 wherein said resin binder is comprised of a mixture of a first binder and a second binder.

26. A photoconductor in accordance with claim 23 wherein said resin binder is present in an amount of from about 30 to about 85 weight percent, wherein said metal oxide is $TiO_2$, and wherein said carbazole compound is present in an amount of from about 0.5 to about 5 weight percent, and wherein the total of said layer components in contact with said supporting substrate is about 100 percent, and wherein said carbazole is chemically attached to said polymer binder.

27. A photoconductor in accordance with claim 23 wherein said carbazole containing compound is 4-hydroxycarbazole, and wherein said resin binder is comprised of a melamine resin, and an acrylic polyol resin in a weight ratio of from about 35/65 to about 65/35.

28. A photoconductor in accordance with claim 26 wherein said chemical attachment to said binder results from the bonding of the resin with at least one hydroxyl functional group present on said carbazole.

29. A photoconductor in accordance with claim 23 wherein said chemical attachment to said binder results from the bonding of the resin with the hydroxyl functional groups present on said carbazole; wherein said carbazole is 4-hydroxycarbazole, and said resin is a phenolic resin.

30. A photoconductor in accordance with claim 2 wherein said chemical attachment to said binder results from the chemical bonding of the resin with the hydroxyl functional groups present on said carbazole.

31. A photoconductor in accordance with claim 1 wherein said carbazole is 4-hydroxycarbazole, said charge transport layer is comprised of N,N'-diphenyl-N,N-bis(3-methylphenyl)-1,1'-biphenyl-4,4'-diamine and a polymer.

* * * * *